US006988897B2

(12) United States Patent
Belongia et al.

(10) Patent No.: US 6,988,897 B2
(45) Date of Patent: Jan. 24, 2006

(54) DETACHABLE BREAKAWAY POWER SUPPLY SOURCE

(75) Inventors: David C. Belongia, Kewaskum, WI (US); William C. Dobson, West Bend, WI (US); Gustave J. Jockers, Chesterfield, MO (US); Hui Ming Kuo, Tainan (TW)

(73) Assignees: Focus Products Group, LLC, Vernon Hills, IL (US); TML, Inc., Barrington, IL (US)

( * ) Notice: Subject to any disclaimer, the term of this patent is extended or adjusted under 35 U.S.C. 154(b) by 0 days.

(21) Appl. No.: 10/414,822

(22) Filed: Apr. 16, 2003

(65) Prior Publication Data

US 2004/0077187 A1 Apr. 22, 2004

Related U.S. Application Data

(60) Provisional application No. 60/376,349, filed on Apr. 29, 2002.

(51) Int. Cl.
*H05B 1/02* (2006.01)

(52) U.S. Cl. ..... 439/39; 219/494; 219/481; 219/491

(58) Field of Classification Search ..... 219/494, 219/481, 490, 491, 505; 439/39, 40, 38; 99/325–338
See application file for complete search history.

(56) References Cited

U.S. PATENT DOCUMENTS

| | | | | |
|---|---|---|---|---|
| 2,830,166 | A | 4/1958 | Loomis | |
| 2,926,230 | A | 2/1960 | Foster | |
| 3,095,498 | A | 6/1963 | Foster | |
| 3,681,568 | A | 8/1972 | Schaefer | |
| 4,163,963 | A | 8/1979 | Ryckman, Jr. | |
| 4,754,253 | A | 6/1988 | Slack et al. | |
| 4,874,316 | A | 10/1989 | Kamon et al. | |
| 4,917,612 | A | 4/1990 | Priest | |
| 5,000,700 | A | 3/1991 | Masubuchi et al. | |
| 5,030,902 | A | 7/1991 | Mattinger et al. | |
| 5,420,398 | A | 5/1995 | Petri et al. | |
| 5,627,507 | A * | 5/1997 | Morbitzer et al. | 337/394 |
| 5,699,034 | A * | 12/1997 | Tsao | 337/394 |
| 5,873,737 | A * | 2/1999 | Hashizawa et al. | 439/39 |
| D439,881 | S | 4/2001 | Choi | |
| 6,250,931 | B1 * | 6/2001 | Mendelson | 439/39 |
| 6,267,602 | B1 | 7/2001 | Mendelson et al. | |
| 6,727,477 | B1 * | 4/2004 | Li-Chen | 219/494 |
| 2002/0086559 | A1 * | 7/2002 | Dalmau-Ferrerfababrega et al. | 439/39 |

* cited by examiner

*Primary Examiner*—Mark Paschall
(74) *Attorney, Agent, or Firm*—Michael Best & Friedrich LLP

(57) ABSTRACT

Objects of the invention relate to a detachable breakaway power supply device that can be selectively coupled to an electrical appliance. A first coupling element is carried by the appliance and a second coupling element is carried by the detachable power supply device. The power supply device is carried by a conventional power supply cord. Attractive magnetic forces between the first and second coupling elements permit selective, removable attachment and electrical contact between the appliance and the power supply device. This arrangement provides a breakaway mechanism in which disturbance of the power supply cord, e.g., by tripping, results in the separation of the power supply device from the appliance to prevent overturning of the appliance and spilling of its contents.

9 Claims, 6 Drawing Sheets

DETACHABLE BREAKAWAY POWER SUPPLY SOURCE

RELATED APPLICATIONS

This application claims the benefit of provisional application Ser. No. 60/376,349, filed Apr. 29, 2002.

FIELD OF THE INVENTION

The invention is directed to detachable power supply sources. In particular, the invention relates to breakaway power supply sources for use with electrical appliances.

BACKGROUND OF THE INVENTION

Detachable power supply systems have long been used with a variety of electrical appliances such as electric skillets, fondue pots, popcorn poppers, etc. Conventional systems allow a power supply source to be detached from the electrical appliance to permit ease of cleaning and storage of the appliance. Typically, the detachable power supply includes a male probe that is inserted into a female receiver on the appliance. During use, intimate contact must be maintained between the probe and the receiver. Therefore, most systems require significant force to separate the probe from the receiver. These conventional systems present significant safety concerns. Disturbance of the power cord, particularly by children and pets, e.g., by tripping, commonly results in overturning of the appliance and spilling of its contents, which may be of boiling temperatures.

U.S. Pat. No. 6,267,602 to Mendelson et al. discloses a breakaway detachable power supply apparatus in which a power supply plug is magnetically coupled to the probe or appliance. The Mendelson device provides a temperature control device having a male temperature probe at one end that is received by a female receiver on the appliance. Attractive magnetic forces between a metal contact plate on the opposite end of the temperature control device and a magnet on a power supply cord couple the temperature control device and the power supply cord during use. Accidental detachment force or disturbance of the cord results in the separation of the power supply cord from the temperature control device to prevent overturning of the appliance. However, disturbance of the power supply cord that results in separation of the power supply cord does not detach the temperature-regulating device from the appliance. The temperature probe remains coupled to the appliance after separation from the power supply plug unless separately removed by the consumer. That is, the point of magnet coupling is between the power supply cord and the temperature-regulating device. One inherent drawback of this system is that the consumer commonly leaves the temperature probe attached to the appliance while immersing the appliance in water for cleaning, which may damage the temperature probe and the temperature regulating capability of the device.

The need remains for effective and cost-efficient breakaway power supply apparatus that provide for consumer convenience and safety.

SUMMARY OF THE INVENTION

Objects of the invention relate to a detachable breakaway power supply device that can be selectively coupled to an electrical appliance. A first coupling element is carried by the appliance and a second coupling element is carried by the detachable power supply device. The power supply device is carried by a conventional power supply cord. Attractive magnetic forces between the first and second coupling elements permit selective, removable attachment and electrical contact between the appliance and the power supply device. This arrangement provides a breakaway mechanism in which disturbance of the power supply cord, e.g., by tripping, results in the separation of the power supply device from the appliance to prevent overturning of the appliance and spilling of its contents.

In one embodiment, the first and second coupling elements are magnets of opposite polarity. It should be appreciated that a magnet may exert a magnetic force on a material that is not magnetized. Therefore, one of the coupling elements can be replaced by a material, e.g., ferrous plate, on which the remaining coupling element is able to exert an attractive magnetic force.

According to one aspect of the invention, a detachable power supply apparatus for an appliance comprises a mounting assembly carried by the appliance and a power supply device carried by a power supply cord. The mounting assembly comprises a heat transfer probe, a heating element terminating in a first electrical terminal, and a first coupling element. The power supply device comprises a temperature regulating device and a second coupling element coupled to the temperature regulating device. The second coupling element is adapted to removably magnetically couple with the first coupling element to couple the appliance with the power supply device. The power supply device also comprises a second electrical terminal adapted for removable electrical contact with the first electrical terminal. Attractive magnetic forces between the first and second coupling elements removably and electrically couple the appliance and the power supply device.

In one embodiment, the temperature regulating device is a bi-metallic mechanical leaf thermostat.

In one embodiment, the heat transfer probe comprises aluminum.

In one embodiment, the first and second coupling elements are magnets of opposite polarity. In an alternative embodiment, the one of the first and second coupling elements is magnetized and the other of the first and second coupling elements is a metal responsive to magnetic forces.

According to another aspect of the invention, a first coupling element, a heat transfer probe, and a heating element carried by an appliance. The heating element terminates in a first electrical terminal. A power supply device is carried by a power supply cord. The power supply device comprises a temperature regulating device and a second coupling element coupled with the temperature regulating device. The second coupling element is adapted to removably magnetically couple with the first coupling element to couple the appliance with the power supply device. At least a portion of the second coupling element is located between the first coupling element and the temperature regulating device when the first and second coupling elements are magnetically coupled, such that severing of the magnetic coupling detaches the power regulating device from the appliance.

According to another aspect of the invention, a heating element terminating in a first electrical terminal and a first coupling element are carried by an appliance. The appliance also carries a heat transfer probe. The heat transfer probe has an inner end portion arranged for contact with the heating element and an outer end portion including a first heat transfer surface. A power supply device is carried by a power supply cord. The power supply device comprises a second electrical terminal to selectively, removably receive the first electrical terminal to provide electrical contact between the appliance and the power supply device. The power supply device also comprises a temperature regulating device and a second coupling element coupled to the temperature regulating device. The second coupling element is adapted for magnetic coupling with the first coupling element. A second heat transfer surface is carried by the second coupling element and arranged for severable heat transfer contact with the first heat transfer surface when the first and second coupling elements are magnetically coupled.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

I. Electrical Appliance

Figure 1:
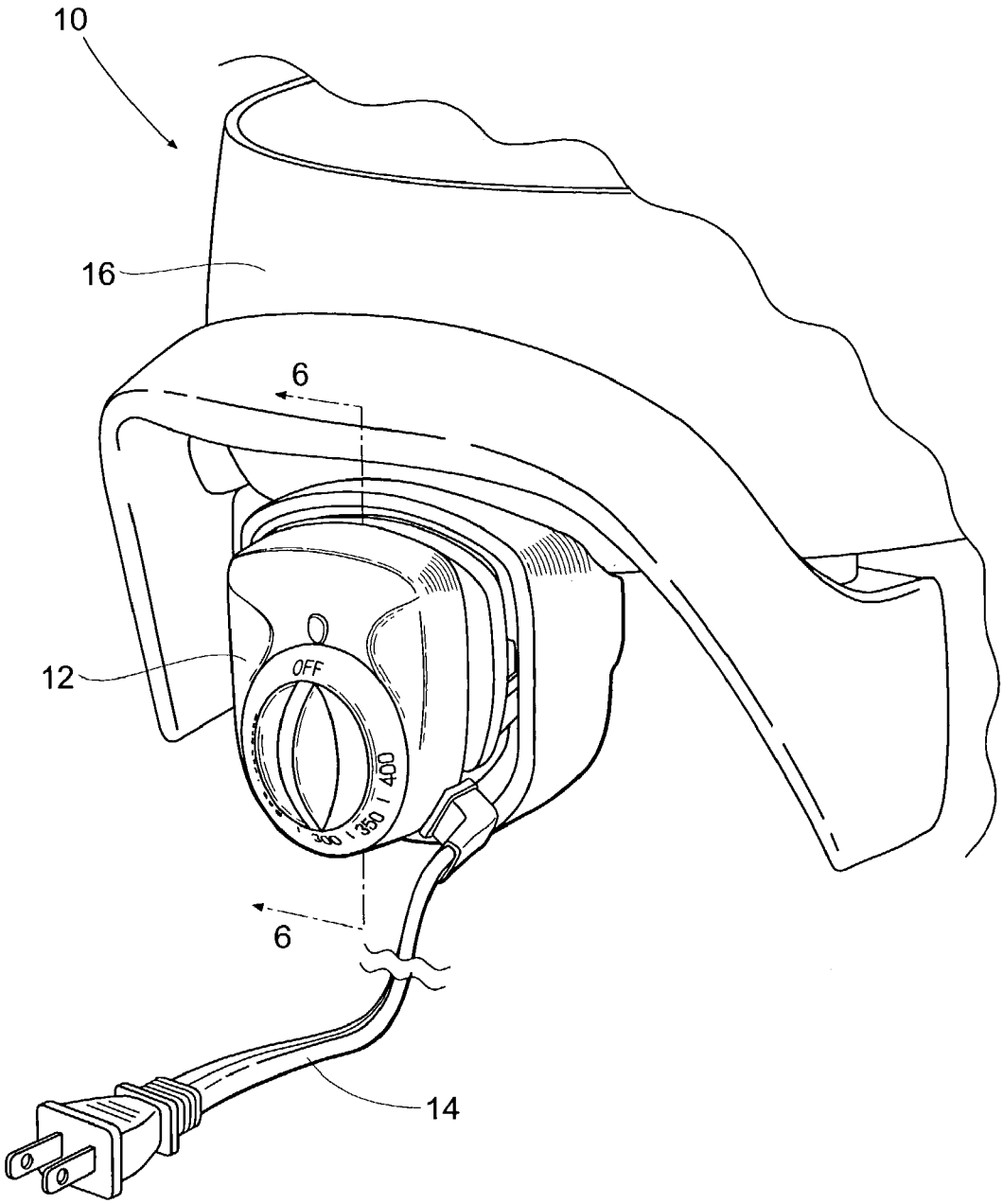
FIG. 1 is a perspective view of a detachable breakaway power supply device coupled to an electrical appliance.
Figure 2:
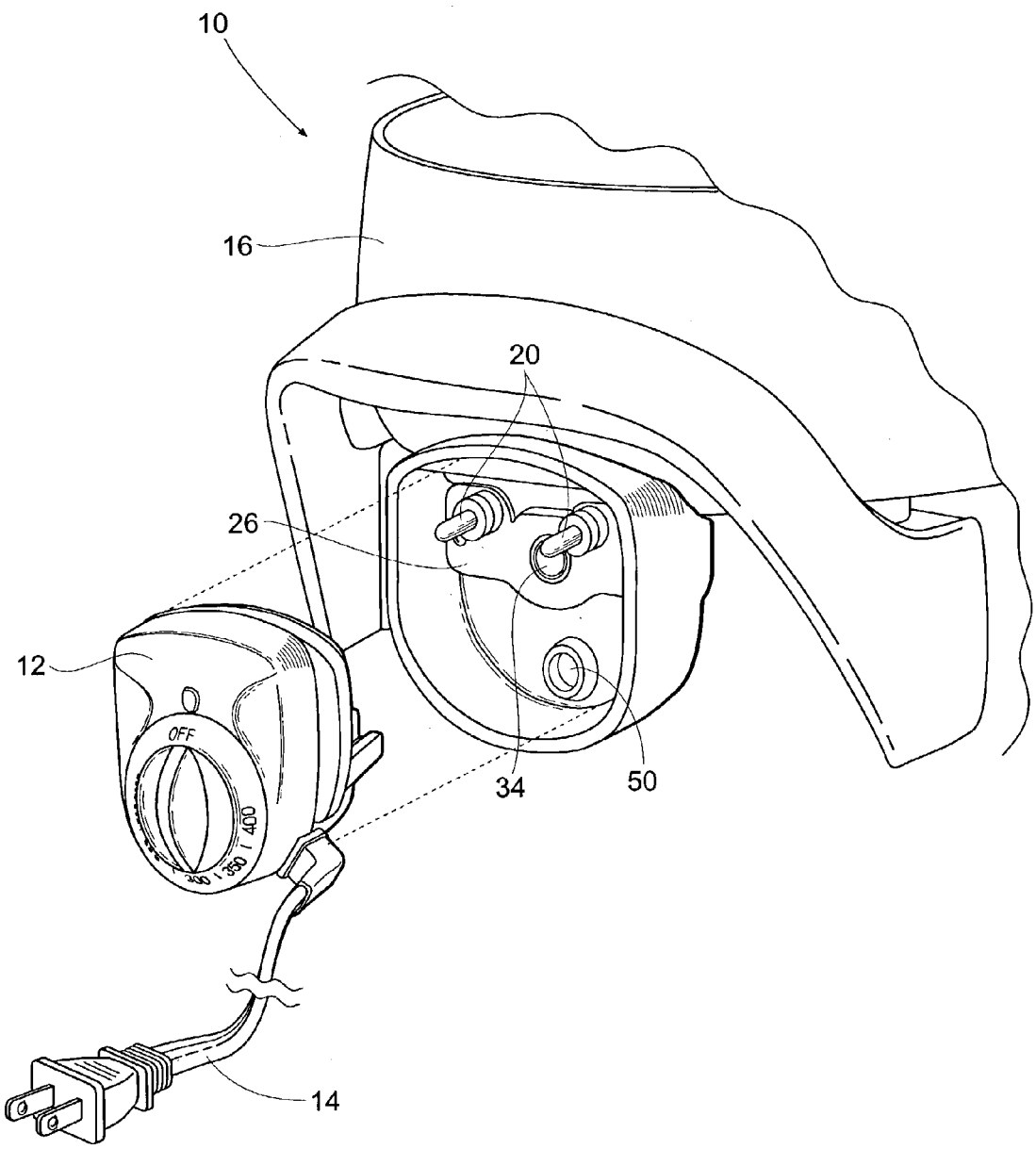
FIG. 2 is a view similar to FIG. 1 and illustrating the power supply device detached from the appliance.

FIG. 1 illustrates an electrical appliance 10 coupled to a power supply device 12 carried by a power supply cord 14. As will be described in greater detail later, the power supply device 12 can be selectively magnetically coupled to the appliance 10 to provide heat transfer and electrical contact between the appliance 10 and the power supply device 12. As shown in FIG. 2, this arrangement provides a breakaway mechanism in which disturbance of the power supply cord 14 results in the separation of the power supply device 12 from the appliance 10 to prevent overturning of the appliance 10. It is to be understood that the power supply device 12 can be coupled to a variety of electrical appliances, including, by way of illustration and not limitation, fondue pots, popcorn poppers, and electric skillets.

Figure 3:
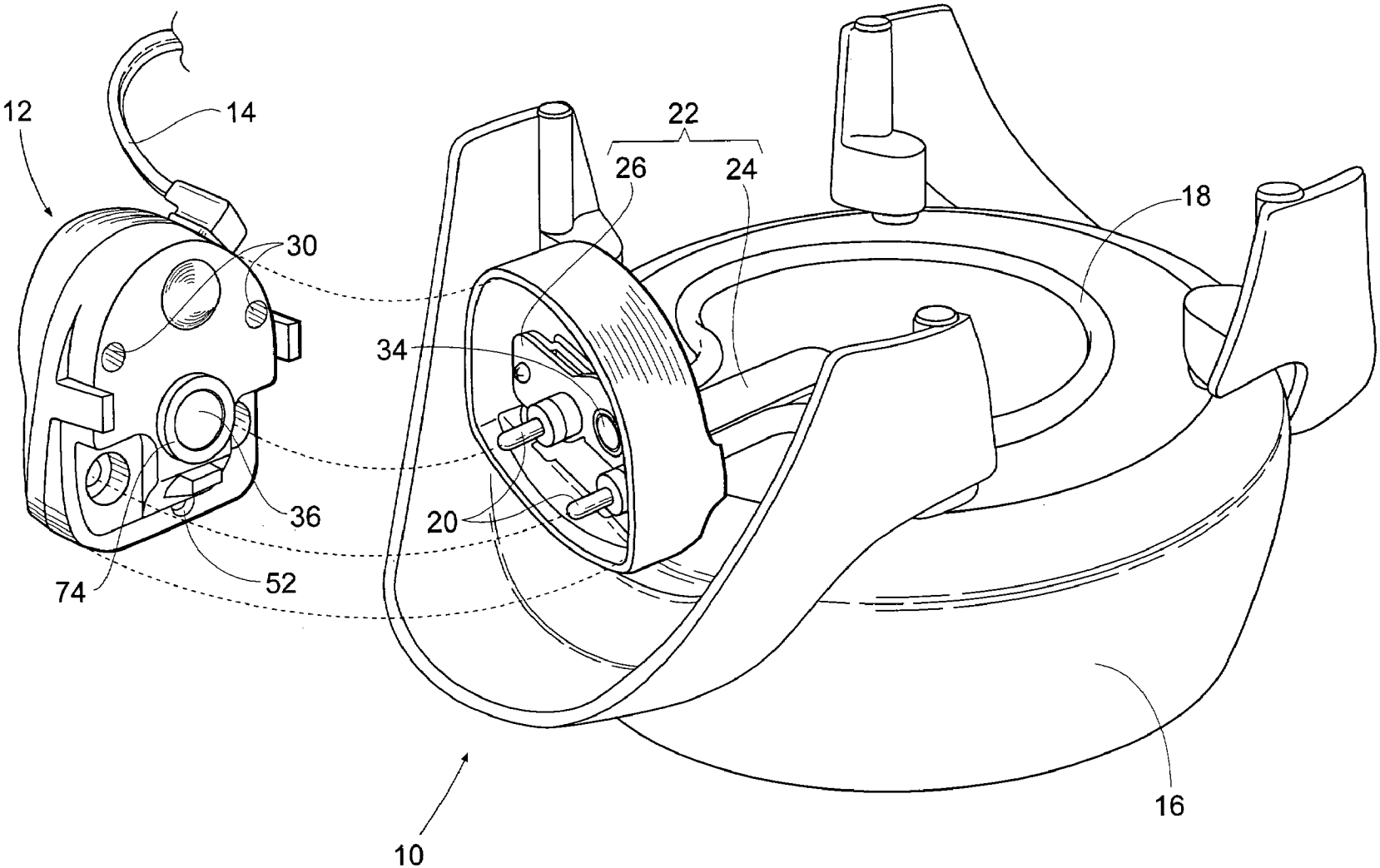
FIG. 3 is bottom perspective view illustrating the power supply device detached from the appliance.
Figure 4:
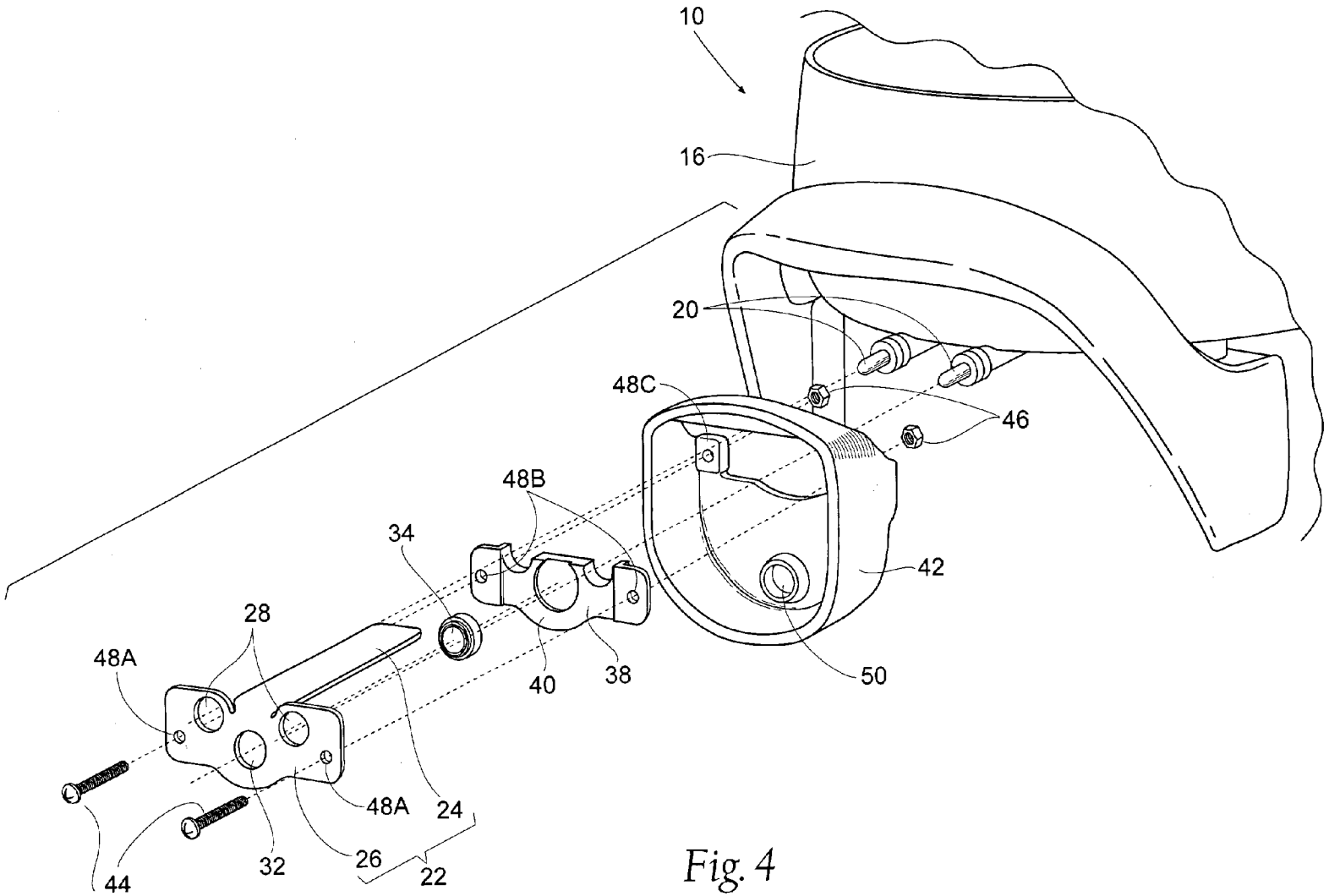
FIG. 4 is an exploded view of a mounting assembly carried by the appliance.

With reference to FIGS. 3 and 4, the appliance 10 comprises a vessel 16 made of aluminum or other suitable heat-conducting metal. The vessel 16 may be heated by any suitable heating element 18. In the illustrated embodiment, the heating element 18 is fixed to the bottom of the vessel 16 and takes the form of a heating coil. The heating coil 18 terminates at each end in a male fitting, with the two male fittings defining a pair of first electrical terminals 20.

A heat transfer probe 22 provides for heat transfer contact between the vessel 16 and the power supply device 12. The probe 22 can be made of aluminum or other suitable heat-conducting metal. In the illustrated embodiment, the heat transfer probe 22 takes the form of an L-shaped bracket having an elongated portion 24 and an arm portion 26 that serves as a first heat transfer surface.

The terminals 20 extend through openings 28 in the first heat transfer 26 surface to permit electrical contact with a pair of second electrical terminals 30 on the detachable power supply device 12, as will be described in greater detail later.

In a preferred embodiment, the heat transfer surface 26 includes an opening 32 such that a first coupling element 34 can be mounted through the opening 32. The first coupling element 34 can be variously sized and configured to magnetically couple with a second coupling element 36 on the power supply device 12 to permit attachment of the power supply device 12 to the appliance 10. This arrangement provides a breakaway mechanism in which disturbance of the power supply cord 14 results in the separation of the power supply device 12 from the appliance 10 to prevent overturning of the appliance 10.

In one embodiment, the first and second coupling elements 34 and 36 are magnets of opposite polarity. It should be appreciated that a magnet may exert a magnetic force on a material that is not magnetized. Therefore, one of the coupling elements 34 or 36 can be replaced by a material, e.g., ferrous plate, on which the remaining coupling element 34 or 36 is able to exert an attractive magnetic force. In a preferred embodiment, the first coupling element 34 is a magnet and the second coupling element 36 is a ferrous plate.

The first coupling element 34 is held in position by a support bracket 38. Desirably, the support bracket 38 includes a recess 40 to receive the first coupling element 34. The heat transfer probe 22, first coupling element 34, and support bracket 38 are secured to a mounting bracket 42 by conventional fasteners, e.g., screws 44 and nuts 46, which are received through openings 48A in the first heat transfer surface 26, 48B in the support bracket 38, and 48C in the mounting bracket 42.

Figure 6:
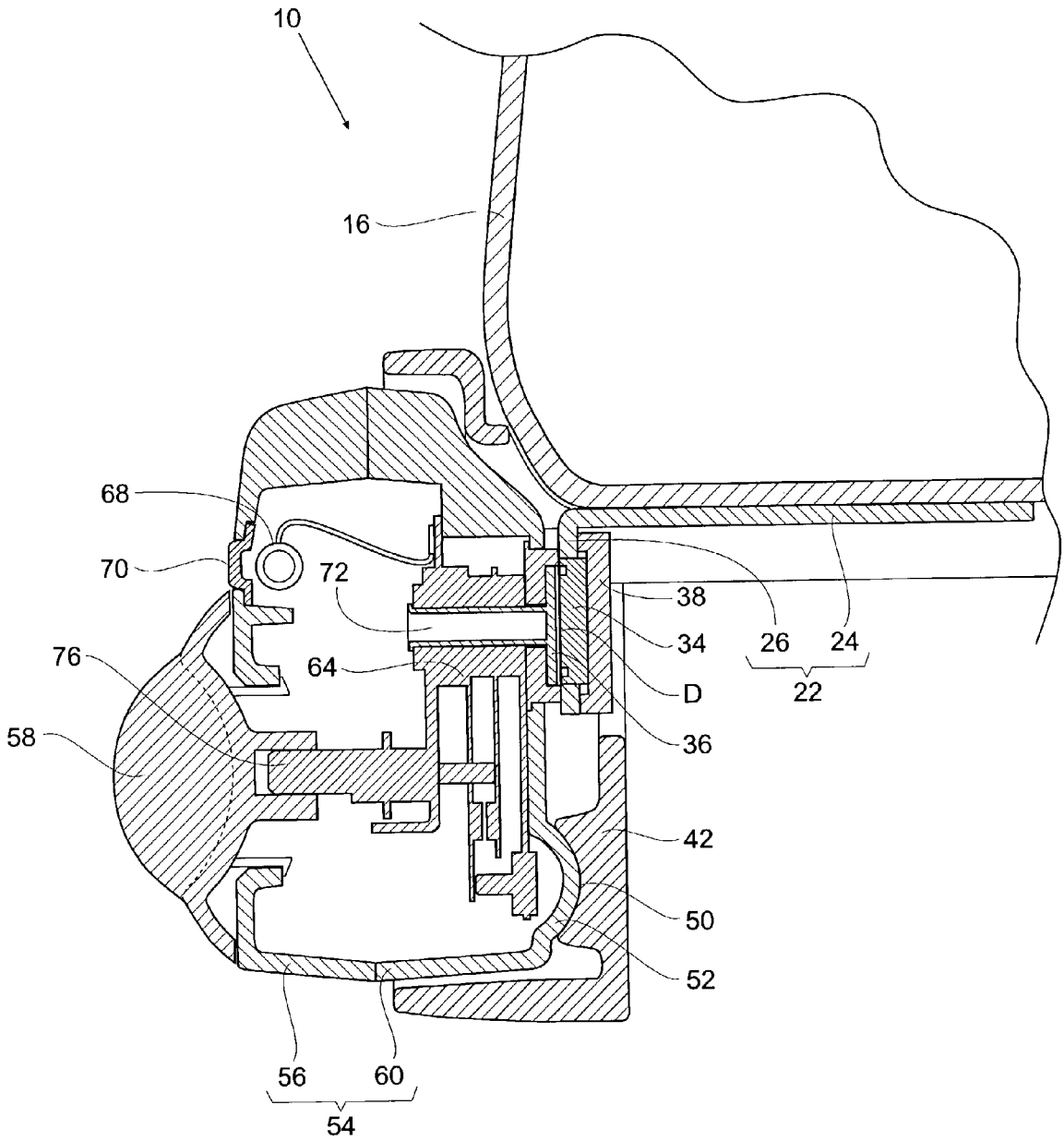
FIG. 6 is a sectional view taken along line 6—6 in FIG. 1.

As best seen in FIG. 6, the mounting bracket 42 may include an alignment recess 50 adapted to mate with a dome 52 on the detachable power supply device 12 to aid in aligning and stabilizing the power supply device 12 when coupling the device 12 with the appliance 10. It is apparent that other alignment mechanisms, e.g., tabs (not shown), can also be provided.

The heat transfer probe 22, the heating element 18, and the first coupling element 34 together define a mounting assembly for coupling the appliance 10 with the power supply device 12.

II. Detachable Power Supply Device

Figure 5:
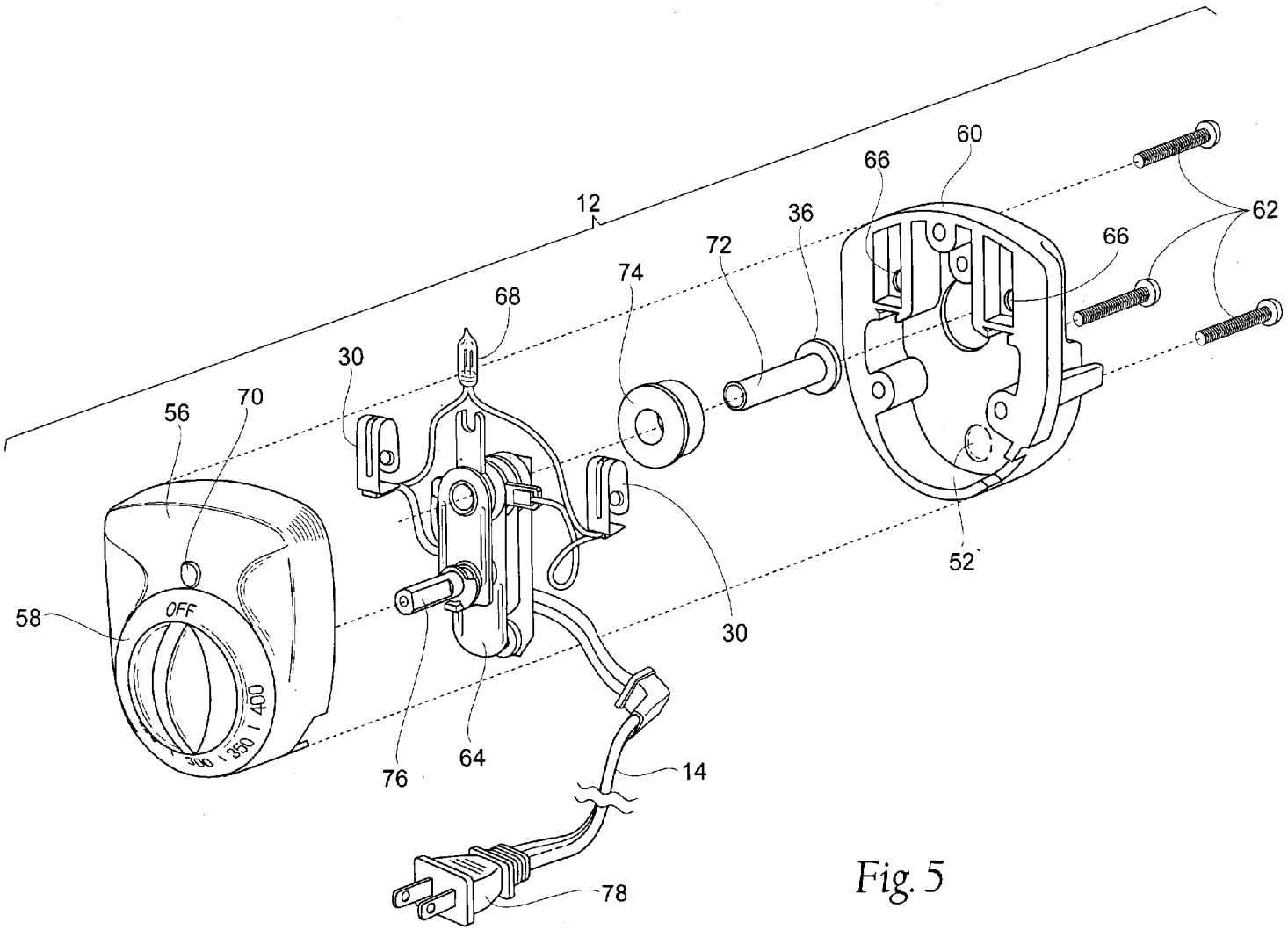
FIG. 5 is an exploded view of the power supply device.

With reference to FIG. 5 and FIG. 6, the detachable power supply device 12 comprises a protective housing 54 having a top portion 56 including a selectable temperature control dial 58 and a bottom or base portion 60. The top and base portions 56 and 60, respectively, can be joined by conventional fasteners, e.g., screws 62, or other suitable means.

The housing 54 carries a temperature-regulating device 64. In the preferred and illustrated embodiment, the temperature-regulating device 64 takes the form of a mechanical leaf thermostat of the type well known in the art. It is to be understood, however, that other suitable temperature-regulating devices 64 can be employed.

The pair of second electrical terminals 30 is coupled with the thermostat 64 and serves to provide selective electrical contact with the first electrical terminals 20 (see FIG. 3). In the illustrated embodiment, the terminals 30 are spring-loaded and adapted to be seated within openings 66 in the housing base 60 that serve as female receivers that mate with male terminals 20 on the heating element 18 to provide electrical contact between the appliance 10 and the power supply device 12. A heating indicator light 68 is also coupled with the thermostat 64 and visible through a window 70 in the housing top 56.

The thermostat 64 is assembled with a rivet 72 that is fixed to the second coupling element 36 and secures the second coupling element 36 to the thermostat 64. The rivet 72 is desirably made of steel or other suitable metal. As previously noted, the second coupling element 36 is adapted to magnetically couple with the first coupling element 34. In this arrangement, disturbance of the power supply cord 14 detaches the power supply device 12, and thus the temperature-regulating device 12, from the appliance 10. That is, the point of magnet coupling is between the temperature-regulating device 64 and the appliance 10.

The rivet 72 also secures a second heat transfer surface 74 to the thermostat 64. The surface 74 is made of a suitable heat-conducting metal, e.g., aluminum. In the illustrated embodiment, the surface 74 takes the form of an annular ring. However, other configurations that provide suitable heat transfer contact between the first and second heat transfer surfaces 26 (see FIG. 3) and 74 can also be employed. As shown in FIG. 6, the ring 74 surrounds the second coupling element 36 and permits transfer of heat from the heat transfer probe 22 to the temperature-regulating device 64.

In the illustrated and preferred embodiment, the plane of the annular ring 74 is slightly elevated relative to the plane of the second coupling element 36 by a distance D, such that the ring 74 permits suitable magnetic attraction between the first and second coupling elements 34 and 36 to couple the appliance vessel 16 with the detachable power supply device 12 without allowing direct contact between the first and second coupling elements 34 and 36. This arrangement assures that the annular ring 74 is in contact with heat transfer bracket 26. This allows the temperature regulating device 64 to properly sense the heat.

The temperature-regulating device 64 also carries a temperature selection pin 76. The pin 76 is actuated by the temperature control dial 58 to selectively set and control the desired temperature. With reference again to FIG. 5, the power supply device 12 is attached to a conventional power supply cord 14 carrying a plug 78 by attachment of the cord 14 to the temperature-regulating device 64.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A detachable power supply apparatus for an appliance, the apparatus comprising (a) a mounting assembly carried by the appliance, the assembly comprising i. a heat transfer probe, ii. a first coupling element, and iii. a heating element terminating in a first electrical terminal, (b) a power supply device carried by a power supply cord, the device comprising i. a second coupling element adapted to removably magnetically couple with the first coupling element to couple the appliance with the power supply device, ii. a temperature regulating device coupled with the second coupling element, and iii. a second electrical terminal adapted for removable electrical contact with the first electrical terminal, wherein attractive magnetic forces between the first and second coupling elements removably and electrically couple the appliance and the power supply device.

2. An apparatus as in claim 1 wherein the temperature regulating device is a bi-metallic mechanical leaf thermostat.

3. An apparatus as in claim 1 wherein the heat transfer probe comprises aluminum.

4. An apparatus as in claim 1 wherein the first and second coupling elements are magnets of opposite polarity.

5. An apparatus as in claim 1 wherein one of the first and second coupling elements is magnetized and the other of the first and second coupling elements is a metal responsive to magnetic forces.

6. An apparatus as in claim 1 wherein at least one of the first and second electrical terminals is spring-loaded.

7. A detachable power supply apparatus for an appliance, the apparatus comprising (a) a first coupling element carried by the appliance (b) power supply device carried by a power supply cord, the device comprising i. a temperature regulating device ii. a second coupling element coupled to the temperature regulating device and adapted to removably magnetically couple with the first coupling element to couple the appliance with the power supply device distal to the temperature regulating device, whereby detachment of the appliance from the power supply device detaches the temperature regulating device from the appliance.

8. A detachable power supply apparatus for an appliance, the apparatus comprising (a) a first coupling element carried by the appliance, (b) a heat transfer probe carried by the appliance, (c) a heating element carried by the appliance and terminating in a first electrical terminal (d) a power supply device carried by a power supply cord, the device comprising i. a temperature regulating device, ii. a second coupling element coupled to the temperature regulating device and adapted to removably magnetically couple with the first coupling element to couple the appliance with the power supply device, at least a portion of the second coupling element being located between the first coupling element and the temperature regulating device when the first and second coupling elements are magnetically coupled, such that severing of the magnetic coupling detaches the power regulating device from the appliance.

9. A detachable regulated power supply apparatus for an appliance, the apparatus comprising (a) a heating element carried by the appliance and terminating in a first electrical terminal, (b) a first coupling element carried by the appliance, (c) a heat transfer probe carried by the appliance and having an inner end portion arranged for contact with the heating element and an outer end portion including a first heat transfer surface, (d) a power supply device carried by a power supply cord, the device comprising i. a second electrical terminal to selectively, removably receive the first electrical terminal to provide electrical contact between the appliance and the power supply device, ii. a temperature regulating device, iii. a second coupling element coupled to the temperature regulating device and adapted for magnetic coupling with the first coupling element, and iv. a second heat transfer surface carried by the second coupling element and arranged for severable heat transfer contact with the first heat transfer surface when the first and second coupling elements are magnetically coupled.

* * * * *